United States Patent [19]

Klopping

[11] 4,063,474

[45] Dec. 20, 1977

[54] TORQUE LIMITING SCREWDRIVER

[75] Inventor: Norman Conrad Klopping, Elmhurst, Ill.

[73] Assignee: Dresser Industries, Inc., Dallas, Tex.

[21] Appl. No.: 629,451

[22] Filed: Nov. 6, 1975

[51] Int. Cl.[2] ..... B25D 23/142

[52] U.S. Cl. ..... 81/52.4 R

[58] Field of Search ..... 81/52.4 R, 52.5; 173/12

[56] References Cited

U.S. PATENT DOCUMENTS

| | | | |
|---|---|---|---|
| 1,860,871 | 5/1932 | Pouliot | 81/52.4 R |
| 2,351,996 | 6/1944 | Morgan | 81/52.4 R |
| 2,984,133 | 5/1961 | Livermont | 81/52.4 R |

FOREIGN PATENT DOCUMENTS

| | | | |
|---|---|---|---|
| 1,503,201 | 5/1969 | Germany | 81/52.4 R |
| 599,637 | 3/1948 | United Kingdom | 81/52.4 R |

*Primary Examiner*—James L. Jones, Jr.

*Attorney, Agent, or Firm*—R. L. Van Winkle; J. N. Hazelwood

[57] ABSTRACT

The improved torque limiting screwdriver described hereinafter includes an elongated bit receptacle that extends into a handle or gripping portion. An operative connection is made between the handle and the bit receptacle by a torque limiting device that can be adjusted to release at predetermined torque settings. The end of the gripping portion opposite to that from which the bit receptacle extends is provided with a cap member that is interconnected with means for adjusting the torque setting. The cap member provides an extension of the gripping portion and presents a smooth end to the user to avoid discomfort during the use of the screwdriver. A threaded fastener extends through the cap member into the gripping portion so that the preset torque can be locked into the torque limiting screwdriver and, thus, avoid the possibility of an inadvertent change of the desired torque setting.

4 Claims, 6 Drawing Figures

TORQUE LIMITING SCREWDRIVER

BACKGROUND OF THE INVENTION

This invention relates generally to improved torque limiting tools. More specifically, but not by way of limitation, this invention relates to a torque limiting screwdriver having a cap member thereon that presents a smooth comfortable surface to the user of the screwdriver.

This invention is an improvement to the screwdriver disclosed in U.S. Pat. No. 2,984,133 which issued May 16, 1961, to F. W. Livermont. The torque limiting screwdriver constructed in accordance with the teachings of the aforementioned patent has been in commercial use for a number of years and has enjoyed considerable success in that the desired torque can be easily set and is positively maintained. However, torque limiting screwdrivers are primarily used in production work where a considerable number or screws are driven to the desired torque setting. As will be appreciated from viewing the drawings of U.S. Pat. No. 2,984,133, the end portion of the gripping means which comes into engagement with the hand of the user of the tool is a very discontinuous surface that is uncomfortable when pressure is exerted on the screwdriver.

Accordingly, an object of this invention is to provide a torque limiting screwdriver that can be quickly and easily adjusted to the desired torque, securely locked at the selected torque, and yet one that presents a comfortable end surface to the user of the tool.

SUMMARY OF THE INVENTION

This invention provides an improved torque limiting screwdriver that includes a bit receptacle extending from one end of a generally cylindrical gripping means and rotatably adjustable torque limiting means operably connecting the bit receptacle with the gripping means. The improvement comprises a cap member arranged to be located at the other end of the gripping means that has an exterior wall portion generally conforming to the gripping means, an exterior end portion providing an essentially smooth surface, a surface portion smoothly connecting the side and end portions and, a connecting portion located interiorly of the wall portion that is connected for rotation with the torque limiting means, whereby the rotation of the cap member relative to the gripping means adjusts the torque of the screwdriver while the cap member prevents discomfort to the user of the screwdriver when force is applied thereto.

The foregoing and additional objects and advantages of the invention will become more apparent as the following detailed description is read in conjuction with the accompanying drawing.

DETAILED DESCRIPTION OF THE PREFERRED EMBODIMENT

Figure 2:
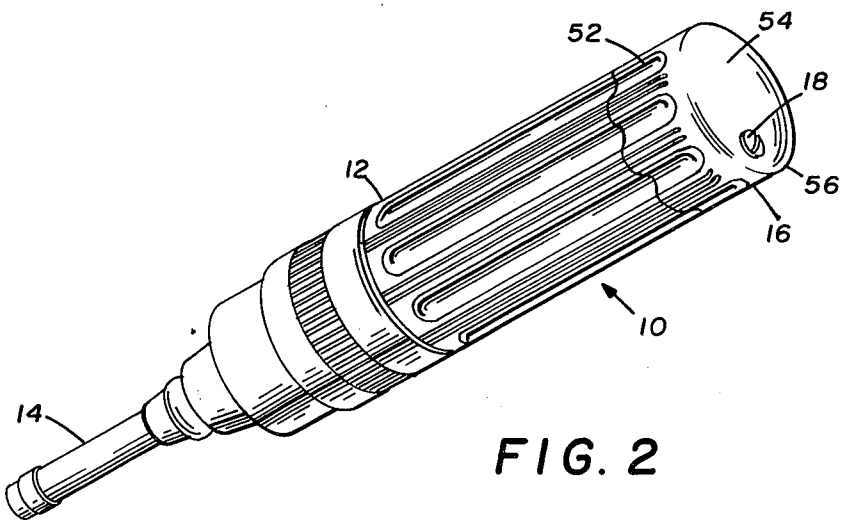
FIG. 2 is a pictorial view similar to FIG. 1, but illustrating a torque limiting screwdriver constructed in accordance with the invention.
Figure 3:
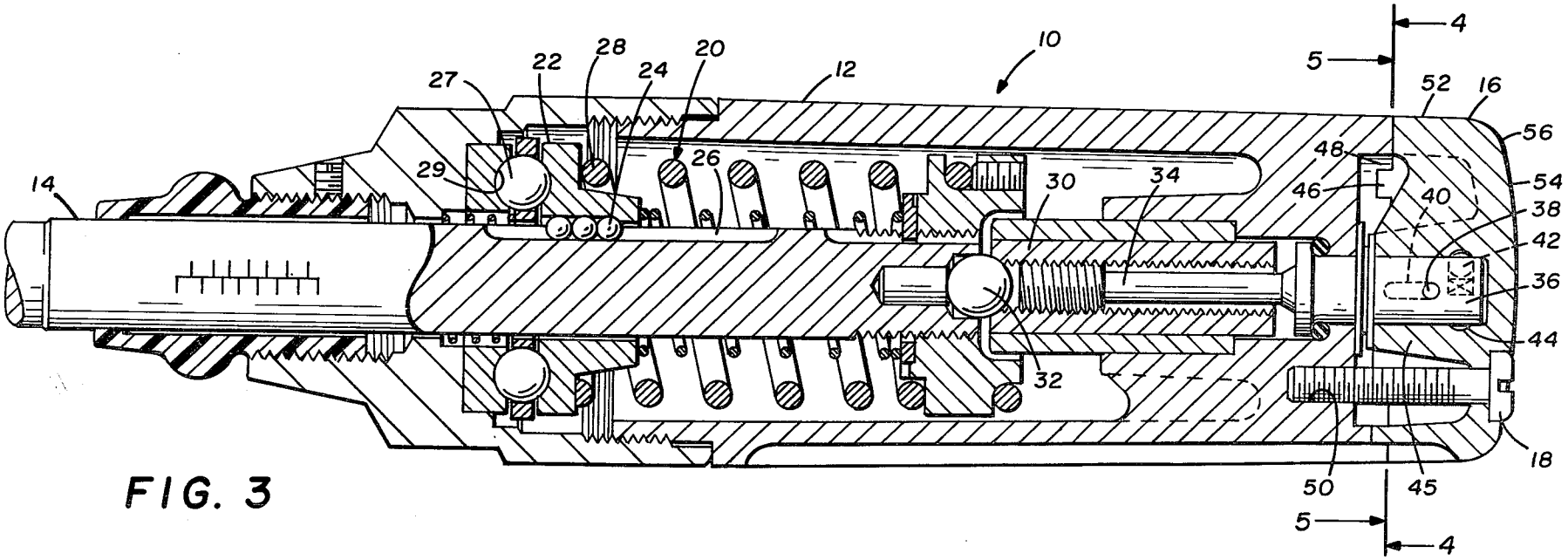
FIG. 3 is a cross-sectional view of a torque limiting screwdriver that is constructed in accordance to the invention.

Referring to the drawings and to FIGS. 2 and 3 in particular, shown therein and generally designated by the reference character 10 is an improved torque limiting screwdriver constructed in accordance with the invention. The screwdriver 10 includes a gripping portion 12 having an elongated bit receptacle 14 extending from one end thereof. At the other end, the screwdriver 10 is provided with a cap member 16 having a torque locking screw 18 extending therethrough.

As may be seen more clearly in FIG. 2, the bit receptacle 14 is operably connected with the gripping portion 12 by torque adjusting means that is generally designated by the reference character 20. The torque adjusting means 20 is clearly described in previously mentioned U.S. Pat. No. 2,984,113.

Briefly, the torque adjusting means 20 includes a clutch 22 that is connected for rotation with the bit receptacle 14 by a plurality of balls 24 that ride in a slot 26 formed in the bit receptacle 14 and with the gripping portion 12 by balls 27 that are located in pockets 29. The amount of force or torque that can be transmitted from the gripping portion 12 through the clutch 22 to the bit receptacle 14 is determined by the compression of the spring 28.

The compression in the spring 28 is determined by the position of sliding sleeve 30 which is in engagement with a ball 32 located in one end of the bit receptacle 14. The position of the sliding sleeve 30 is determined by the torque adjusting screw 34.

As shown in FIG. 3, right hand end portion 36 of the torque adjusting screw 34 is unthreaded and extends into the cap member 16. The end portion 36 is pinned to the cap member 16 by a pin 38 that extends through a slot 40 in the cap member 16. The slot 40 is shown in dash lines therein. The slot 40 is provided to permit the cap member 16 to be moved axially with respect to the adjusting screw 34 as will be described hereinafter.

A spring loaded ball 42, also shown in dash lines in FIG. 2, is located in the portion 36 and operates in conjunction with the annular groove 44 formed in a connecting portion 45 of the cap member 16 to releasably retain the cap member 16 in the position illustrated in FIGS. 2 and 3. As previously mentioned, the locking screw 18 extends through the cap member 16 into threaded engagement with the gripping portion 12 to positively lock the cap member 16 in the position illustrated when desired.

To further lock the cap member 16 to the gripping portion 12, preventing inadvertent changes in the torque setting, the cap member 16 and the gripping portion 12 are provided with serrations 46 and 48 respectively. The serrations 46 and 48 may be more clearly seen in FIGS. 4 and 5.

Figure 4:
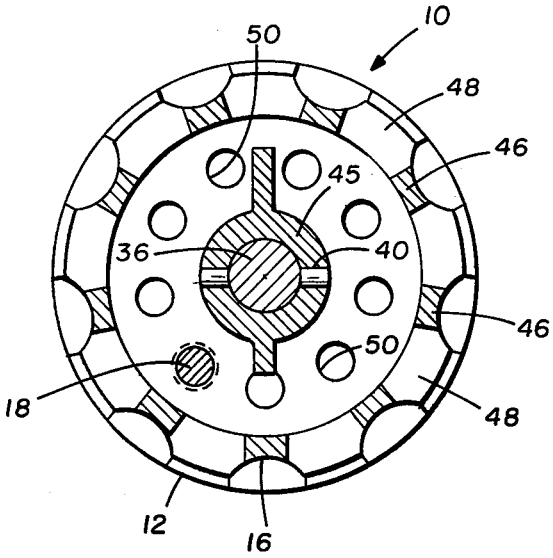
FIG. 4 is a transverse cross-section taken generally along the line 4—4 of FIG. 3.
Figure 5:
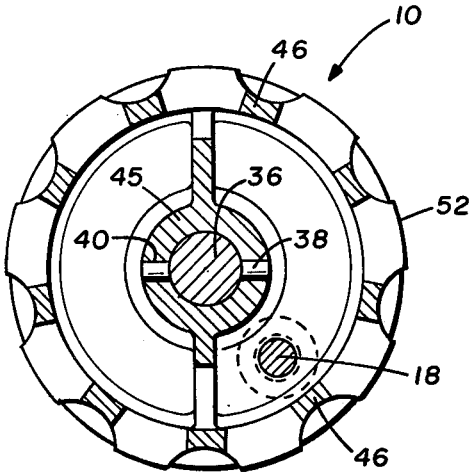
FIG. 5 is another transverse cross-sectional view taken along the line 5—5 of FIG. 3.

Referring to FIG. 4, it can be seen therein that the gripping portion 12 is provided with a plurality of circumferentially spaced and threaded holes 50 for receiving the locking screw 18. The holes 50 are spaced so that the locking screw 18 can be utilized in any position of the cap member 16 when the serrations 46 and 48 are in mating relationship.

Figure 1:
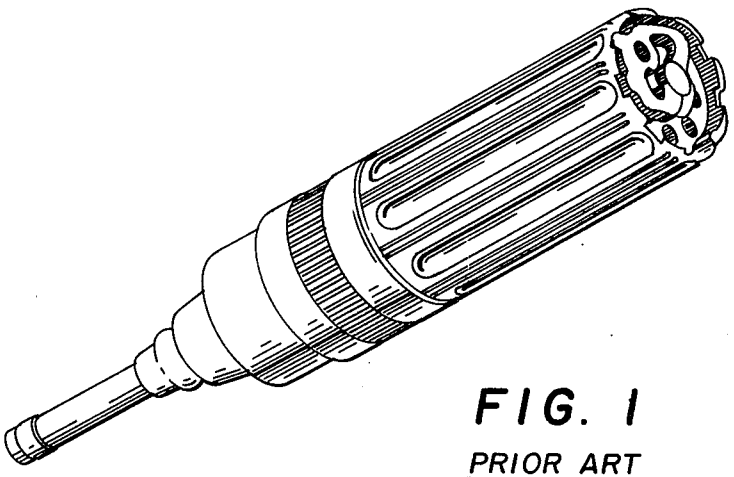
FIG. 1 PRIOR ART
FIG. 1 is a pictorial view of a torque limiting screwdriver constructed in accordance with the prior art.

In addition to the connecting portion 45, the cap member 16 includes an exterior wall portion 52 that generally conforms to the exterior wall of the gripping portion 12, a substantially smooth exterior end portion 54 that is smoothly connected with the wall portion 52 by a radiused surface 56. Thus, and as can be appreciated more clearly from FIG. 2, the cap member 16 provides a smooth comfortable end for the user of the tool thereby preventing discomfort when the force is exerted thereon in contrast with the same end of the prior art screwdriver illustrated in FIG. 1.

Figure 6:
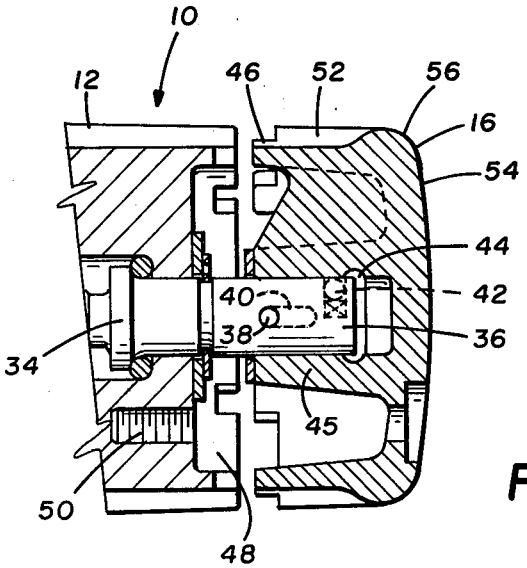
FIG. 6 is a partial cross-sectional view illustrating a portion of the torque limiting screwdriver of FIG. 2 with the screwdriver components in the position that they occupy during adjustment of the torque setting.

FIG. 6 illustrated the relationship of the cap member 16 and the gripping portion 12 during the setting of the torque limit in the screwdriver 10. As shown therein, the locking screw 18 has been removed and the cap 16 has pulled to the right depressing the spring loaded ball 42 so that it no longer resides in the annular groove 44. Since the pin 38 is in the slot 40 formed in the connecting portion 45 of the cap member 16, the cap member 16 can be moved to the position illustrated while maintaining the ability to rotate the torque adjusting screw 34 by turning the cap member 16.

In the position illustrated, the serrations 46 on the cap member 16 and the serrations 48 on the gripping portion 12 are out of engagement. Thus, rotation of the cap member 16 transmits rotation to the torque adjusting screw 34 moving the sleeve 30 axially and also moving the bit receptacle 14 axially either compressing or releasing compression of the spring 28 to change the release pressure on the clutch 22 and, thus, varying the amount of torque that can be transmitted through the screwdriver 10.

When the desired torque setting has been attained, the cap member 16 is moved to the left as illustrated in FIG. 6 until it reaches the position illustrated in FIG. 3, that is, until the serrations 46 and 48 are again in mating relationship. When this occurs, and if the torque setting is to be retained for an extended period, the locking screw 18 is again inserted through the cap member 16 into one of the threaded holes 50 securely locking the cap member 16 to the gripping portion 12 and thus assuring that inadvertent changes will not occur in the torque limit set into the screwdriver 10.

From the foregoing, it will be appreciated that a screwdriver constructed in accordance with the invention provides a smooth end surface for the user while at the same time maintaining the ability to be quickly and easily adjusted to the torque setting desired.

Having described but a single embodiment of the invention, it will be understood that the detailed description presented hereinbefore is provided by way of example only, and that many changes and modifications can be made thereto without departing from the spirit and scope of the invention.

The embodiments of the invention in which an exclusive property or privilege is claimed are defined as follows:

1. In an improved torque limiting screwdriver including a bit receptacle extending from one end of a generally cylindrical gripping means and rotatably adjustable torque limiting means operably connecting the bit receptacle with the gripping means, and the gripping means includes a plurality of radially spaced holes extending generally parallel to the bit receptacle, the improvement comprising a cap member arranged to be located at the other end of the gripping means and having:

an exterior wall portion generally conforming to the gripping means;

an exterior end portion providing an essentially smooth surface;

a surface portion smoothly connecting said wall and end portions;

a connection portion located interiorly of said wall portion connected for rotation with the torque limiting means, whereby rotation of said cap member relatively to the gripping means adjusts the torque limit of said screwdriver while said cap member prevents discomfort to the user of said screwdriver when force is applied thereto;

a hole through said end portion aligned with the holes in the gripping means; and releasable fastening means located in the hole in said cap member and arranged to be located in one of the holes in the gripping member to prevent inadvertent rotation of the cap member relative to the gripping means and releasable therefrom to permit relative rotation therebetween to adjust the torque limit.

2. In the improved screwdriver of claim 1 wherein the torque limit means includes a pin for connecting the torque limit means to said cap member and the gripping means includes serrations in the end thereof adjacent to the cap means, said cap means also including:

a slot in said connection portion to receive the pin permitting movement of said cap member relatively away from the gripping means while connecting said cap member to the torque limiting means for rotation therewith;

serrations in said cap member for making engagement with the serrations in the gripping member, said serrations and spaced holes being located in spaced relationship whereby said fastening means will be aligned with one of the holes in the gripping means when said serrations are engaged to lock the torque limit means in the desired adjusted position preventing inadvertent changes therein.

3. In an improved torque limiting screwdriver including a bit receptacle extending from one end of a generally cylindrical gripping means and rotatably adjustable torque limiting means, including a pin, operable connecting the bit receptacle with the gripping means, the improvement comprising a cap member arranged to be located at the other end of the gripping means and having:

an exterior wall portion generally conforming to the gripping means;

an exterior end portion providing an essentially smooth surface;

a surface portion smoothly connecting said wall and end portions; and a connection portion located interiorly of said wall portion connected for rotation with the torque limiting means, whereby rotation of said cap member relative to the gripping means adjusts the torque limit of said screwdriver while said cap member prevents discomfort to the user of said screwdriver when force is applied thereto, and said connection portion including a slot to receive the pin permitting movement of said cap member relatively away from the gripping means while connecting said cap member to the torque limit means for rotation therewith.

4. In the improved screwdriver of claim 3, wherein the gripping means includes serrations in the end thereof adjacent to said cap member and said cap member has mating serrations in the exterior wall portion thereof adjacent to the gripping member, whereby said cap member can be located with the serrations disengaged permitting rotation of said cap member relative to the gripping means to adjust the torque limit or engaged to prevent rotation of said cap member relative to the gripping member.

* * * * *